US005291824A

United States Patent [19]

Matsumoto et al.

[11] Patent Number: 5,291,824

[45] Date of Patent: Mar. 8, 1994

[54] DOT LINE PRINTER HAVING ORDINARY LOW DOT AND HIGH DOT DENSITY PRINTING MODES

[75] Inventors: Yoshikane Matsumoto; Hiroto Inagawa; Shingo Nakahara; Youichi Hujita, all of Katsuta, Japan

[73] Assignee: Hitachi Koki Co., Ltd., Tokyo

[21] Appl. No.: 755,371

[22] Filed: Sep. 5, 1991

[30] Foreign Application Priority Data

Sep. 7, 1990 [JP] Japan ..... 2-238193
Nov. 30, 1990 [JP] Japan ..... 2-337670
Jun. 11, 1991 [JP] Japan ..... 3-138097

[51] Int. Cl.[5] ..... B41J 3/00

[52] U.S. Cl. ..... 101/93.04; 400/121; 400/323

[58] Field of Search ..... 400/323, 124, 121, 157.2, 400/322; 101/93.04, 93.05, 93.16

[56] References Cited

U.S. PATENT DOCUMENTS 4,819,556 4/1989 Abe et al. ..... 101/93.04
5,059,047 11/1991 Nakamura et al. ..... 400/322

FOREIGN PATENT DOCUMENTS 0015170 1/1985 Japan ..... 400/323
0132061 6/1988 Japan ..... 400/323
0153153 6/1988 Japan ..... 400/323
0153154 6/1988 Japan ..... 400/323
0027957 1/1989 Japan .

*Primary Examiner*—Edgar S. Burr
*Assistant Examiner*—Christopher A. Bennet
*Attorney, Agent, or Firm*—Sughrue, Mion, Zinn, Macpeak & Seas

[57] ABSTRACT

A dot line printer provided with an ordinary dot density printing mode, a low dot density or draft printing mode and a high dot density printing mode. A hammer bank provided with a plurality of printing hammers is reciprocally movable in a shuttling direction for dot impressions when the hammer bank is moved through a printing region, and the moving direction of the hammer bank is reversed at a reversing region where a printing sheet is fed in a line to line direction. A shuttle cam is provided which is drivingly connected to the hammer bank. The shuttle cam has a cam profile capable of providing a cam lift characteristic approximately intermediate between a cam lift characteristics of the ordinary printing mode and that of the low dot density printing mode. A shuttling velocity of the hammer bank is changed in accordance with the selected printing mode and position of the hammer bank.

6 Claims, 8 Drawing Sheets

DOT LINE PRINTER HAVING ORDINARY LOW DOT AND HIGH DOT DENSITY PRINTING MODES

BACKGROUND OF THE INVENTION

The present invention relates to a dot line printer in which dot line impressions are carried out during reciprocal movement of a hammer bank which secures a plurality of dot printing hammers. More particularly, the invention relates to such a dot line printer having at least two printing modes different from each other, which is capable of selectively performing dot printings under at least ordinary printing mode and a draft printing mode.

Generally, the dot line printer produces a dot line image during one shuttling movement of the hammer bank, and a plurality of the dot lines will produce one character line during the reciprocal movement of the hammer bank. Throughout the specification and claims, the terms "shuttling direction" imply a reciprocal moving direction of the hammer bank or one dot line extending direction, and the terms "line to line direction" imply a sheet feeding direction or a direction of an array of character lines.

In accordance with the development of data processing techniques, high printing speed and printing quality are required in a dot impact type line printer, which is one typical data output device. However, the requirement of high speed printing is in direct conflict with the requirement of high quality image printing, and thus it is very difficult to satisfy the both requirements at one time.

Further, depending on a processing mode, only one of the requirements may be needed. For example, in case of an ordinary office work, ordinary printing speed is available with a standardized ordinary dot density. On the other hand, if "draft printing" is to be performed, high speed printing is achieved by lowering the dot density. Further, if high dot image quality printing is to be performed, the printing speed must be decreased. This is a conventional dot line printer, a plurality of dot density modes can be set, and a selected one of the dot density modes is used for achieving an intended dot printing speed or print imaging quality. Such conventional dot line printers will be described below with reference to FIG. 1.

In the conventional dot line printer shown in FIG. 1, an ordinary dot density is 160 dpi (dots per inch) in the shuttling direction and 168 dpi in the line to line direction, and 6 dot lines are simultaneously printed during one shuttling motion of a hammer bank 8. The hammer bank 8 is provided with a plurality of printing hammers 16 arrayed in the shutting direction, and one end is connected to a shuttle mechanism S. The shuttle mechanism S generally includes a shuttle motor 1 such as a DC servo motor and a cam mechanism C which includes a shuttle cam 2 coupled to an output shaft of the shuttle motor 1, a shift plate 4 connected to the hammer bank 8, and a pair of cam followers 5 rotatably supported on the shift plate 4. The shuttle cam 2 is in rolling contact with the cam followers 5, and the shuttle cam 2 is eccentrically coupled to the output shaft of the shuttle motor 1, Therefore, the hammer bank 8 is bidirectionally moved in the shuttling direction by the single rotation of the shuttle motor 1 through the cam mechanism C.

The shuttle motor 1 is connected to a motor driver 25 connected to a control circuit 24. Further, a rotary encoder 26 is provided on the output shaft of the shuttle motor 1, and a sensor 27 connected to the control circuit 24 is positioned over the rotary encoder 26.

A platen 20 extends in the shutting direction and is spaced away from the hammer bank 8 by a predetermined gap. A printing sheet 9 is positioned between the platen 20 and the hammer bank 8. Further, an ink ribbon 29 is positioned between the printing sheet 9 and the hammer bank 8. The platen 20 bears dot impression force from the printing hammers 16, and serves to guide a travel of the printing sheet 9. The ink ribbon 29 is moved along an ink ribbon path defined by ribbon guides 23, 23, and is driven by a pair of ink ribbon drive rollers 21, so that the ink ribbon can be foldedly or corrugatedly accommodated in an ink ribbon cassette 22.

The shuttle motor 4 is driven for rotating the shuttle cam 2 by the motor driver 25 controlled by the control circuit 24. The rotation speed of the shuttle motor 1 is detected by the sensor 27 through the rotary encoder 26. A detection signal indicative of the motor rotation speed is transmitted to the control circuit 24 for a feed back control so as to provide a controlled constant rotation speed of the shuttle motor 1.

FIGS. 2 and 3 show a more detailed arrangement of the conventional shuttle mechanism S and a sheet feed mechanism F. In FIG. 2, a U-shaped shuttle frame 7 is disposed around the shift plate 4, and bearings 6 are provided at arm end portions of the shuttle frame 7. Through the bearings 6, 6, a shift shaft 3 axially movably extends, which is connected to the one end of the hammer bank 8. Another end of the hammer bank 8 is fixed to a bank shaft 17 which is slidingly supported by a shuttle bearing 19 fixed on a bank shaft holder 18.

The sheet feed mechanism F includes a sheet feed motor 10 fixedly secured to a side frame 30. A motor shaft of the sheet fed motor 10 extends through the side frame 30 and a drive pulley 11 is coupled to the motor shaft. A drive shaft 14 is rotatably supported by the side frames 30, and a driven pulley 13 is coupled to one end of the drive shaft 14. An endless belt 12 is mounted on the drive and the driven pulleys 11 and 13 for rotating the drive shaft 14 about its axis. A tractor 15 is mounted on the drive pulley 14 for feeding the printing sheet 9 in the sheet feeding direction, i.e, line to line direction.

In FIG. 3, the printing sheet 9 is intermittently fed in the line to line direction as indicated by an arrow Y when no dot printing is carried out to the printing sheet, i.e., when the hammer bank 8 is moved to a hammer bank reverse moving region. More specifically, by means of the shuttle mechanism S, the hammer bank 8 repeatedly performs reciprocal movement in the shuttling direction indicated by an arrow X in FIG. 3 in accordance with a cam profile of the shuttle cam 2 which defines a cam lift characteristic as shown in FIG. 4. In the cam lift characteristic shown in the graph of FIG. 4, in a printing regions P1 and P2, the hammer bank 8 is moved at a constant velocity, and in two reverse moving regions R1 and R2, the hammer bank speed is changed for reversibly changing the moving direction of the hammer bank 8. In the two reverse moving regions R1 and R2, the printing sheet 9 is fed by a predetermined dot number pitches by means of the above described sheet feed mechanism F. Thus, the dot printing in one shuttling direction is achieved without the sheet feed in the P1 region, and when the hammer bank 8 is reversely moved in the reverse moving region (R2) the sheet feeding with the predetermined length is performed, and thereafter, the dot line printing in an opposite shuttling direction is performed in the P2 region.

In such conventional dot line printers, in order to increase printing speed, the draft printing mode is selected in which dot density in the shuttling direction is lowered, and a rotation speed of the shuttle motor 1 is increased to increase moving velocity of the hammer bank 8. In order to maintain a given printing quality, the reverse moving period , i.e., the sheet feeding period in the draft printing mode must be equal to the period in case of the ordinary printing mode. However, the lift characteristic of the shuttle cam 2 of the conventional dot printer is designed to meet with the ordinary printing mode. Therefore, if the rotation speed of the shuttle motor 1 is increased for the draft printing, reverse period of the hammer bank 8 is also shortened. To make the reverse period in the draft mode equal to that in the ordinary printing mode, rotation speed of the shuttle motor 1 is reduced at the time of the reverse period in the draft printing mode. This will be explained with reference to FIGS. 5 and 6.

FIG. 5 shows the relationship between an angular velocity $\omega$ of the shuttle motor 1 in the reverse and the printing/periods of the hammer bank 8. A line I represents the angular velocity $\omega_1$ of the shuttle motor 1 under the ordinary printing mode in one moving direction of the hammer bank 8, and a line II represents the angular velocity $\omega_2$ of the shuttle motor 1 under the draft mode in the one moving direction of the hammer bank 8. When using the shuttle cam 2 which provides the reversing period and the printing period of the hammer bank 8 such as those shown in the line I in the ordinary printing mode at the angular velocity $\omega_1$, the reverse period would be reduced if the angular velocity of the shuttle motor 1 is increased to $\omega_2$.

In order to obviate this problem, and to make the reverse period in the draft mode equal to that in the ordinary printing mode, angular velocity of the shuttle motor 1 must be controlled at the reverse period of the hammer bank 8 in the draft printing mode as shown in FIG. 6. That is, when the hammer bank 8 is moved at a transitional position from the printing position to the reversely moving position in the draft printing mode, the angular velocity $\omega_2$ at the time of the printing period is suddenly reduced to $(2\omega_1-\omega_2)$, and when the hammer bank 8 is moved from the reversely moving position to the printing position, the angular velocity $(2\omega_1-\omega_2)$ is rapidly increased to $\omega_2$. That is, deceleration and acceleration of the shuttle motor 1 is repeatedly performed at the reversing period. Accordingly, a large shuttle motor 1 must be used so as to provide high output capable of providing a maximum output torque of $$2I(\omega_2-\omega_1)/t_F$$

where I designates a moment of inertia of the output shaft of the shuttle motor, and $t_F$ designates a half period of the sheet feeding period.

SUMMARY OF THE INVENTION

It is therefore, an object of the present invention to overcome the above described drawbacks and to provide an improved dot line printer in which small shuttle motor providing a small output torque is available even under the operation of draft mode printing by restraining the variation in rotation speed of the shuttle motor within a limited range.

These and other objects of the present invention will be attained by providing a dot line printer for printing dot images on a printing sheet comprising (a) a hammer bank in which a plurality of print hammers are arrayed in a shuttling direction, the hammer bank being reciprocally movable in the shuttling direction, (b) a shuttling mechanism for moving the hammer bank in the shuttling direction, the shuttling mechanism comprising a shuttle motor and a cam mechanism drivingly connected to the hammer bank and having a shuttle cam driven by the shuttle motor, the hammer bank moving through a printing region where print hammers move toward the printing sheet for printing and a reversing region where the moving direction of the hammer bank is reversed and the print sheet is fed in a line to line direction, the hammer bank and the shuttling mechanism providing at least ordinary dot density printing mode and a low dot density printing mode where a draft printing is executed with increasing moving speed of the hammer bank, and (c) the shuttle cam having a cam profile whose cam-lift characteristic is substantially intermediate between a cam-lift characteristic of the ordinary dot density printing mode and a cam lift characteristic of the low dot density printing mode.

In another aspect of the present invention, there is provided a dot line printer for printing dot images on a printing sheet comprising (a) a hammer bank in which a plurality of print hammers are arrayed in a shuttling direction, the hammer bank being reciprocally movable in the shuttling direction, (b) a sheet feed mechanism for feeding the printing sheet in a line to the line direction, (c) a shuttling mechanism for moving the hammer bank in the shuttling direction, the shuttling mechanism comprising a shuttle motor and a cam mechanism drivingly connected to the hammer bank and having a shuttle cam driven by the shuttle motor, the hammer bank moving in a printing period through a printing region where the print hammers move toward the printing sheet for printing and moving in a reversing period through a reversing region where the moving direction of the hammer bank is reversed and the print sheet is fed in the line to line direction, and (d) control means connected to the shuttle motor for changing a rotation speed of the shuttle motor to provide a first rotation speed for executing an ordinary dot density print mode, a second rotation speed higher than the first rotation speed for executing a low dot density printing mode and a third rotation speed lower than the first rotation speed for executing a high dot density printing mode, the control means further controlling the rotation speed of the shuttle motor at the reversing period of the low dot density and high dot density printing modes so as to provide an average rotation speed proximate to a rotation speed of the reversing period of the ordinary dot density printing mode.

With this arrangement, the variation in rotation speed of the shuttle motor is reduced to a small range, to thereby make it possible to provide a compact and small-output motor. If the lift characteristic of the shuttle cam is configured proximate to that at the ordinary printing mode, average velocity of the hammer bank at the time of the ordinary printing mode can be lowered. Thus, maximum acceleration can also be reduced, which in turn leads to reduction in vibration, and speed variation attendant thereto, to thereby facilitate acceleration control.

Further, by optimumly changing rotation speed of the shuttle motor in accordance with the printing region and the reversing region as well as in accordance with the selected printing mode, dead or idle time in the reversing region can be minimized, and excessive acceleration of the cam mechanism can be avoided.

DETAILED DESCRIPTION OF THE PREFERRED EMBODIMENTS

Figure 8:
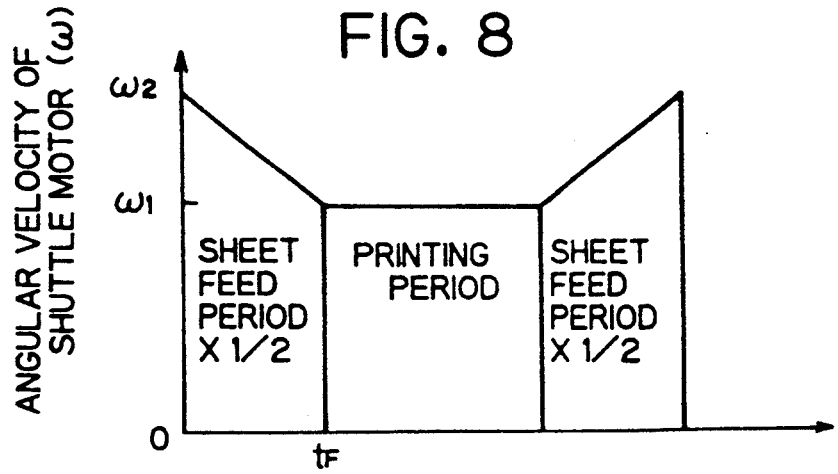
FIG. 8 is a graph showing a change in the angular velocity of the shuttle motor in the reversing period under the ordinary printing mode according to the first embodiment.
Figure 9:
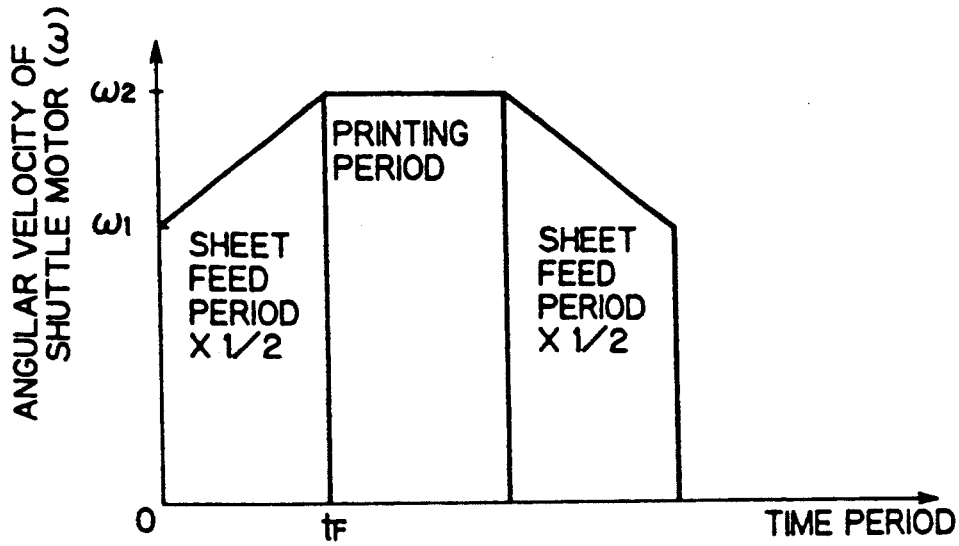
FIG. 9 is a graph showing a change in the angular velocity of the shuttle motor in the reversing period under the draft printing mode according to the first embodiment.

A dot line printer according to a first embodiment of the present invention will be described with reference to FIGS. 7 through 9. Essential construction of the printer is substantially the same as that of the conventional printer except for a profile of a shuttle cam which exhibits a lift characteristic different from that of the conventional shuttle cam.

Figure 1:
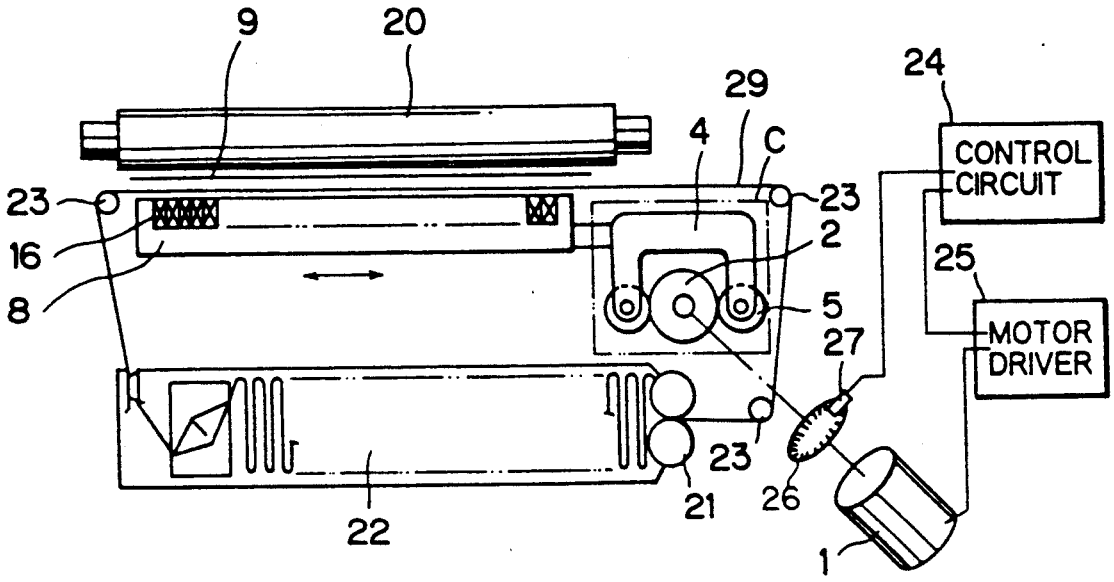
FIG. 1 PRIOR ART
FIG. 1 is a schematic plan view showing a general arrangement of a conventional dot line printer.
Figure 2:
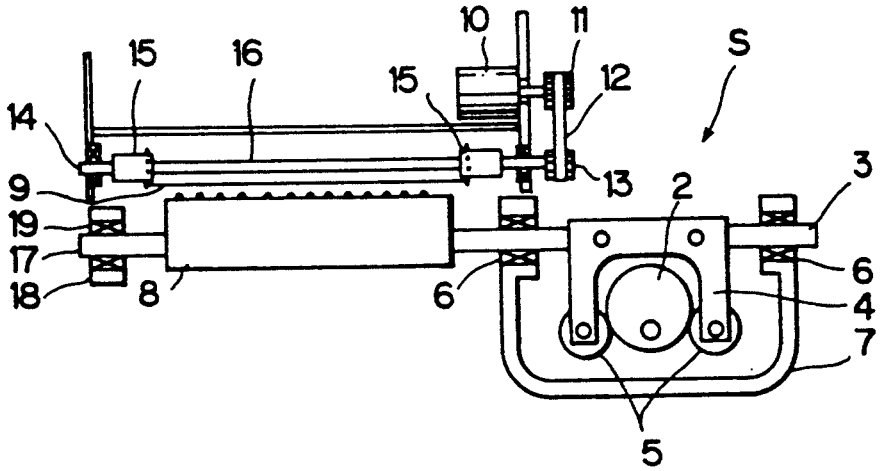
FIG. 2 PRIOR ART
FIG. 2 is a schematic plan view showing a shuttle mechanism and a sheet feed mechanism in the conventional dot line printer.
Figure 3:
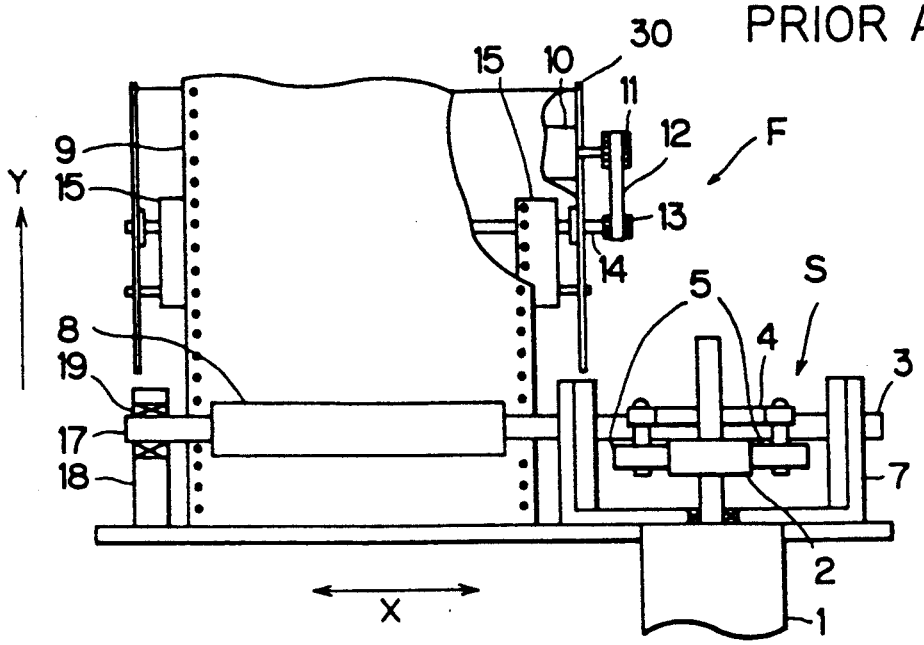
FIG. 3 PRIOR ART
FIG. 3 is a schematic front view showing the shuttle mechanism and the sheet feed mechanism in the conventional dot line printer.
Figure 4:
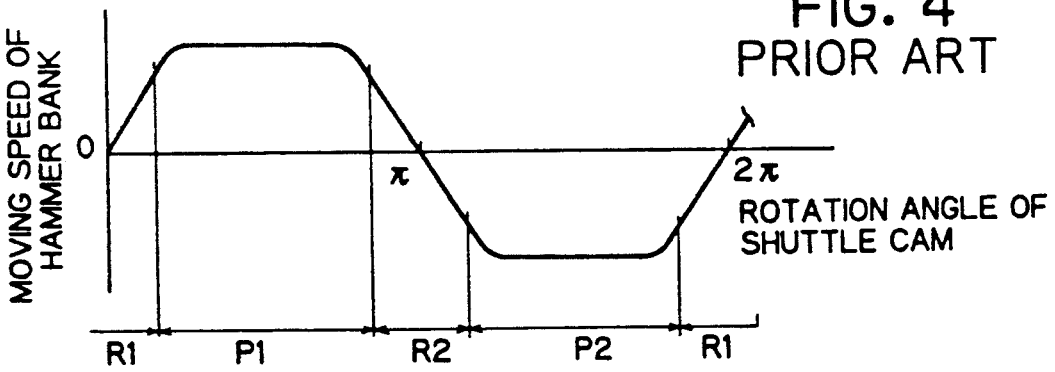
FIG. 4 PRIOR ART
FIG. 4 is a graphical representation showing the relationship between the moving speed of the print hammer and reverse and printing periods of the hammer bank in the conventional printer.
Figure 5:
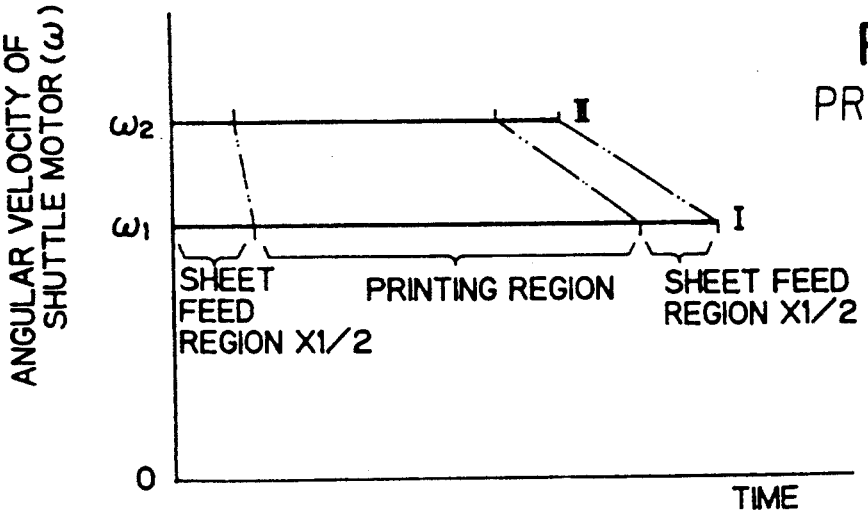
FIG. 5 PRIOR ART
FIG. 5 is a graph for description of reduction in reverse period in a draft printing mode when angular velocity of a shuttle motor is increased.
Figure 6:
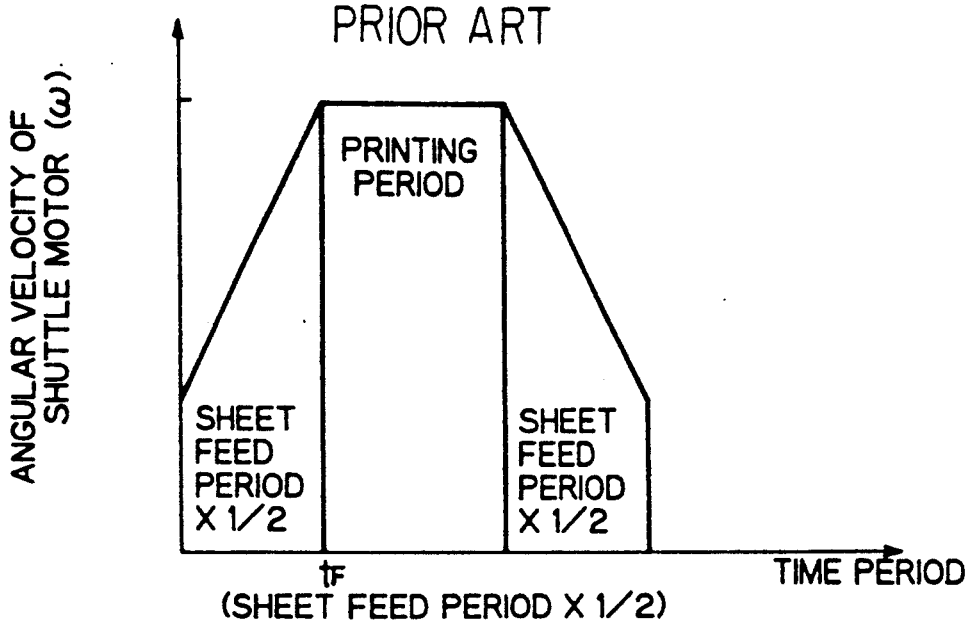
FIG. 6 PRIOR ART
FIG. 6 is a graph for description of abrupt change in angular velocity of the shuttle motor for making the reversal period of the hammer bank in the draft printing mode equal to that in the printing period.
Figure 7:
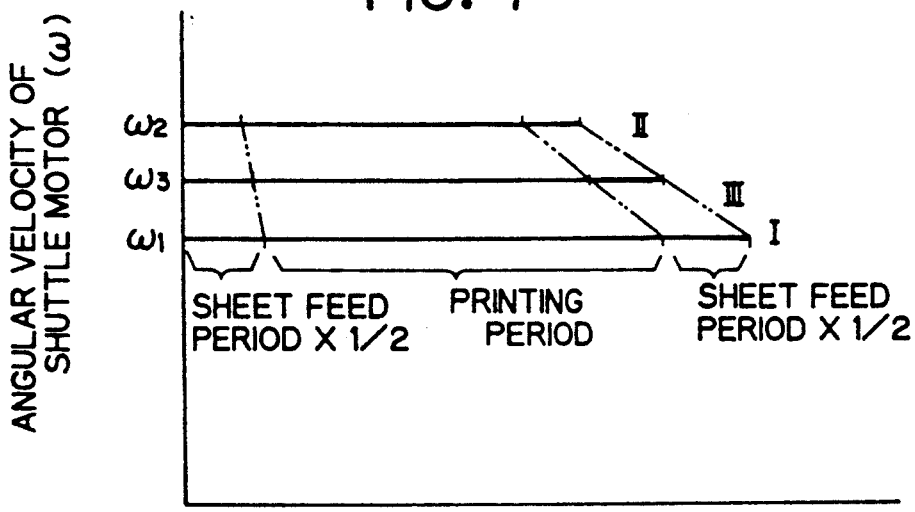
FIG. 7 is a graph showing the relationship between an intermediate angular velocity of a shuttle motor and sheet feeding and printing periods attendant to a shuttle cam according to a first embodiment of the present invention.

More specifically, in the graph shown in FIG. 7, which shows angular velocity curves of a shuttle motor 1, similar to the graph of FIG. 5, the lines I and II show angular velocities $\omega 1$ and $\omega_2$ of the ordinary printing mode and the draft or low dot density printing mode, respectively in one directional full movement of the hammer bank 8. Further a line III represents an intermediate angular velocity $\omega_3$ of the shuttle motor 1 between the two angular velocities. Under this intermediate angular velocity $\omega_3$, the profile of the shuttle cam 2 is designed so as to provide a lift characteristic capable of moving the hammer bank 8 at an intermediate speed between the ordinary printing speed and the draft printing speed (higher than the ordinary printing speed and lower than the draft printing speed), and capable of providing a predetermined sheet feeding period.

By the employment of the shuttle cam 2, if the angular velocity of the shuttle motor 1 is lowered to $\omega_1$, the paper feeding period becomes greater than the period $t_F$. Therefore, as shown in FIG. 8, the angular velocity of the shuttle motor 1 at the reverse period of the hammer bank 8 must be increased. Reversely, under the draft printing mode, if the angular velocity of the shuttle motor 1 is increased to $\omega_2$, the paper feeding period becomes smaller than the period $t_F$. Therefore, as shown in FIG. 9, an average angular velocity of the shuttle motor 1 at the reverse period must be lowered. The angular velocity of the shuttle motor 1 at the reverse period is increased or decreased at the reverse period of the ordinary printing mode and the draft printing mode. The shuttle motor 1 should only provide an output torque of $I(\omega_2-\omega_1)/t_F$, which torque value is a half of the required output torque of the shuttle motor in the conventional dot line printer.

According to the first embodiment of this invention, since the required output torque of the shuttle motor can be reduced to a half level, a shuttle motor having a small mass and providing a small output torque is available in a dot line printer even under the high speed draft printing mode.

Figure 10:
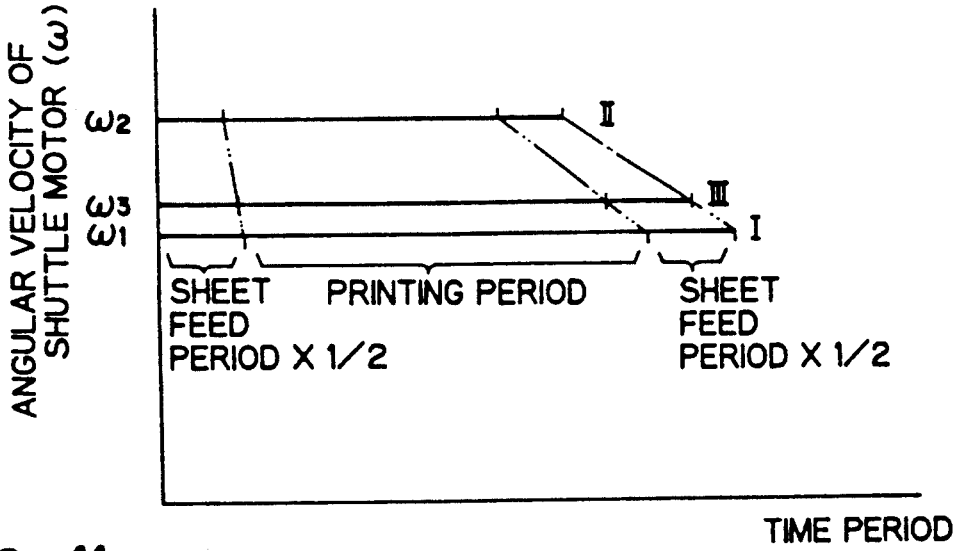
FIG. 10 is a graph showing the relationship between another angular velocity of a shuttle motor which velocity is more adjacent to the angular velocity of the ordinary printing mode, and the reversing ( or sheet feeding) and the printing periods attendant to a shuttle cam according to a second embodiment of the present invention.

A dot line printer according to a second embodiment of this invention will be described with reference to Fig. 10. In the second embodiment, a lift characteristic of a shuttle cam 2 is more close to the ordinary printing mode in comparison with the first embodiment. With this arrangement, even though the acceleration and deceleration of the shuttle motor 1 becomes greater than that of the first embodiment in case of reversing period of the draft printing mode, average velocity in case of the reversing period of the ordinary printing mode can be lowered. Because of the average speed reduction in the reversing period, maximum acceleration which is proportional to two powers of the speed can be greatly lowered. Consequently, generation of the vibration of the printer can be restrained at a minimum level, and rotation speed variation of the shuttle motor due to the vibration can also be reduced, to thereby facilitate speed control to the shuttle motor 1. Even though required output torque of the shuttle motor becomes greater than that of the first embodiment, the above described advantages attendant to the second embodiment are greater than the disadvantage.

In view of the foregoing, according to the present invention, a draft printing is achievable by the employment of the shuttle motor having small output torque. This leads to minimization of the motor, reduction in electric power consumption, and minimization of a motor drive circuit and a power source. Consequently, compact dot line printer can be provided at a lower cost.

A dot line printer according to a third embodiment will next be described. The printer of the third embodiment is provided with an ordinary dot density printing mode, low dot density printing mode and high dot density printing mode. Before entering into substantive description to the third embodiment, general technical problems underlying this type of dot line printer will first be described.

Figure 11:
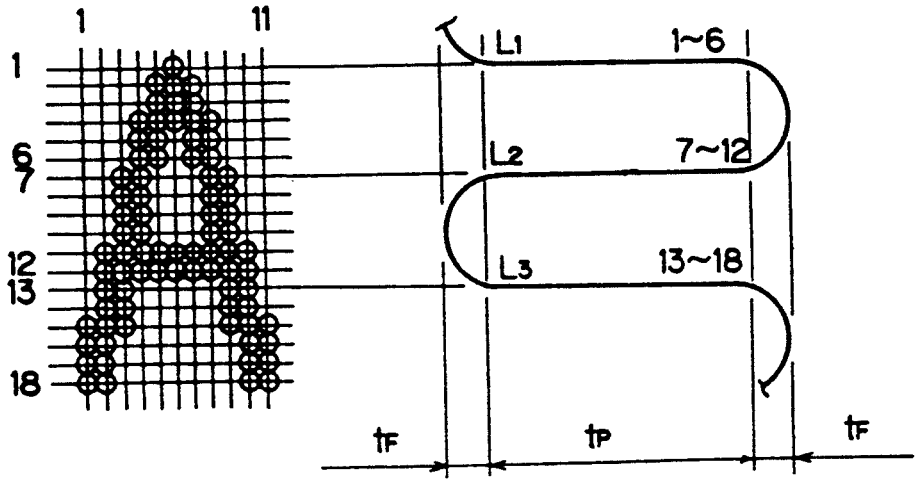
FIGS. 11 through 13 are views for description of ordinary dot density printing mode, low dot density printing mode (draft mode) and a high dot density printing mode, respectively.

FIG. 11 shows an ordinary dot density printing in which a character "A" containing 18 dots in the line to line direction is printed by three lateral movements of the hammer bank 8 (in the shuttling direction). For example, at a first movement L1 of the hammer bank 8, six dot printing is performed. Thereafter, the hammer bank 8 is further moved into the reversing region during which the printing sheet is moved in the line to line direction by a length corresponding to subsequent 6 dots. Then, the hammer bank is moved in a second moving locus L2 in a direction opposite the first movement so that the subsequent 6 dots are printed. The hammer bank is moved into another reversing region during which the printing sheet is again moved in the line to line direction by a length corresponding to the 6 dots. Then, the hammer bank is again moved in the first direction in third moving locus L3. Thus, 18 dots are printed (in the line to line direction). Thereafter, the printing sheet is fed by a length corresponding to a pitch of character lines for starting dot printing for the character of a next character line.

In FIG. 11, assuming that printing period and the reversing period are designated by $t_F$ and $t_F$, respectively, a complete one directional moving time period $t_S$ of the hammer bank 8 is represented by an equation $t_S=t_P+t_F$. Since single character line printing requires three times movements of the hammer bank 8, it takes a period of $3t_S$ for the single character line printing. Accordingly, the print speed $P_n$ (character lines per minute) is represented by the following equation.

$$P_n=60\times 1/(3t_s)=20/t_s$$

Figure 12:
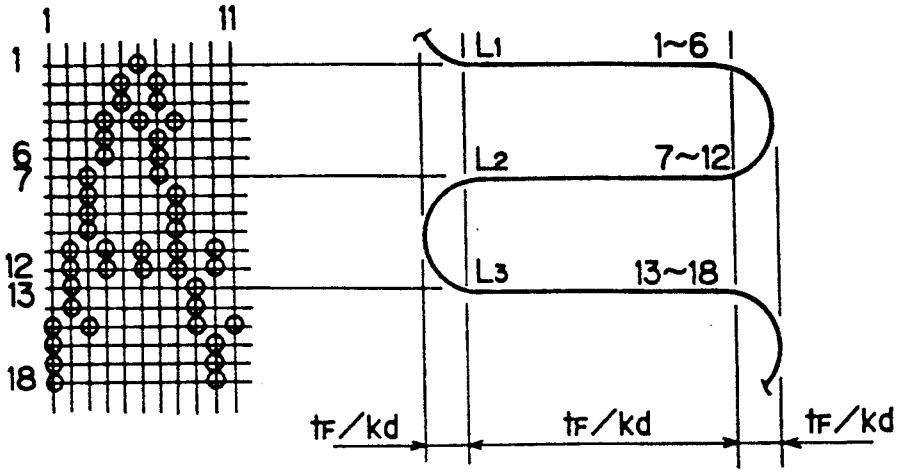

In the low dot density printing, moving speed of the hammer bank 8 is k times as high as an ordinary hammer bank speed in order to increase the printing speed. Under such high moving speed condition, dot printing with the ordinary dot density is made impossible in view of inherent dot impacting frequencies of the printing hammers 16. Thus, in the high speed dot printing, as shown in FIG. 12, dot impressions in the shuttling direction is made every other hammers or alternate hammers, to thereby degrade the printing quality. Other printing manner is the same as that in the ordinary dot line printing. Therefore, in the low dot density printing, the printing time period and the reversing time period fall to $t_P/k_d$, and $t_F/k_d$, respectively, and a complete one directional moving time period t of the hammer bank 8 is represented by $t_d=t_s/k_d=(t_p+t_F)/k_d$. Accordingly, a printing speed $P_d$ (character lines per minute) is represented by the following equation. $P_d=60\times k_d/(3t_S)=20k_d/t_s=P_nk_d$. Incidentally, $k_d$ is generally in a range of from 1.15 to 1.2.

Figure 13:
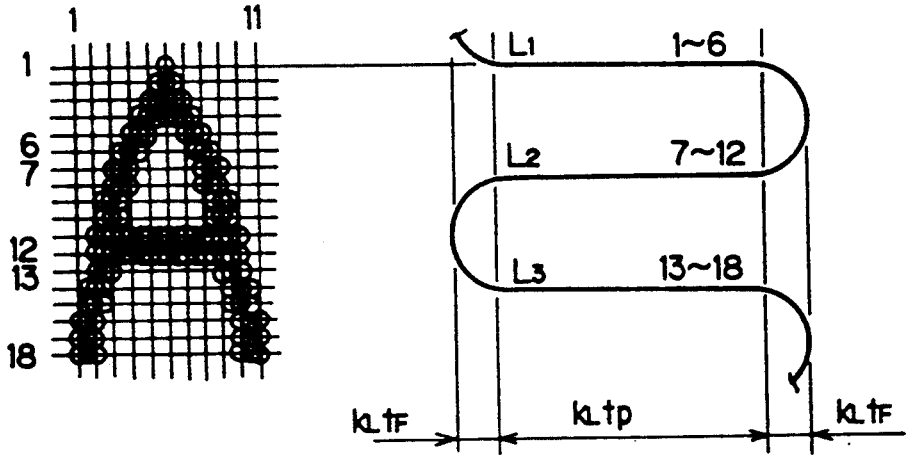

Next, high dot density printing will be described with reference to FIG. 13, in which moving speed of the hammer bank 8 is $1/k_L$ of the ordinary moving speed thereof (in FIG. 13, $k_L=2$). In this printing, even though printing quality is greatly improved, printing speed is reduced. That is, printing period and reversing period of the hammer bank fall $k_Lt_p$, respectively, and accordingly, a complete one directional moving time period $t_L$ of the hammer bank 8 is represented by $t_L=k_Lt_s=k_L(t_P+t_F)$. Accordingly, a printing speed $P_L$ per a minute is represented by the following equation.

$$P_L=60\times 1/(3k_Lt_S)=20/k_Lt_S=P_n/k_L$$

Incidentally, the above explanations are made with respect to the simultaneous six dot impressions in the line to line direction. However, the explanation is also available for the single row, two row or eight row impressions in case of ordinary, low dot density and high dot density printings.

Figure 14:
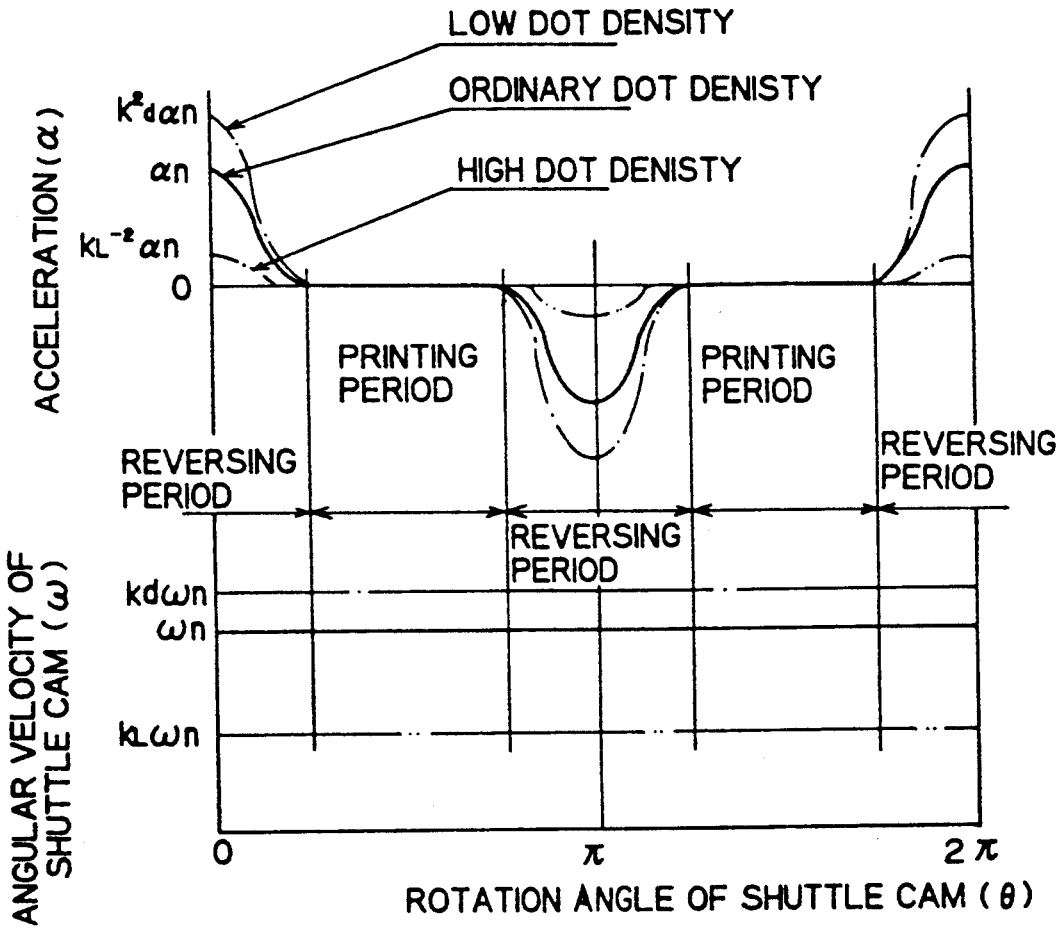
FIG. 14 is a graphical representation for description of angular velocities of a shuttle cam (or a shuttle cam shaft) and acceleration thereof with respect to a rotational angular position of the shuttle cam in case of the ordinary dot density printing mode (solid line), the low dot density printing mode (a dotted chain line) and the high dot density printing mode (two dotted chain line)

With the above in view, several factors exist which prevents the hammer bank from moving at high speed. First, since the reversing period in the low dot density printing is $t_F/k_d$, the reversing period $t_F$ in the normal dot density printing contains idle period of $\{t_F-(t_F/k_d)\}$. Second, the shuttle mechanism S must be designed such that it should provide a rigidity capable of sustaining maximum acceleration of the cam mechanism C when the shuttle motor 1 is rotated at high speed for performing the low dot density printing. Therefore, resultant shuttle mechanism S becomes bulky. This fact is apparent from the relationship between the angular velocity of the shuttle cam 2 (angular velocity of the shuttle motor 1) and the acceleration of the shuttle cam 2 (acceleration of the hammer bank 8) as shown in FIG. 14. More specifically, the acceleration of the cam mechanism C is proportional to the square of the rotation speed. Thus, if the printing speed of the low dot density is 1.2 times as high as that of the high dot density printing, acceleration in the low dot density printing becomes 1.44 times as high as that of the high dot density printing. Consequently, the shuttle mechanism S must be designed to sustain a load at the time of maximum acceleration (1.44 times). Third, reversing period ($t_{F/kL}$) in the high dot density printing is far greater than that ($t_F/k_d$) in the low dot density printing, which in turn lowers the entire printing period.

The third embodiment is configured in an attempt to provide a compact shuttle mechanism in spite of an increase in printing speed by optimumly changing rotation speed of the shuttle motor in accordance with the printing period and the reversing period, contrary to a constant rotation speed of the shuttle motor regardless of the printing and reversing period, the latter providing vain or idle time period in reversing zone and increases in acceleration in the cam mechanism.

Figure 15:
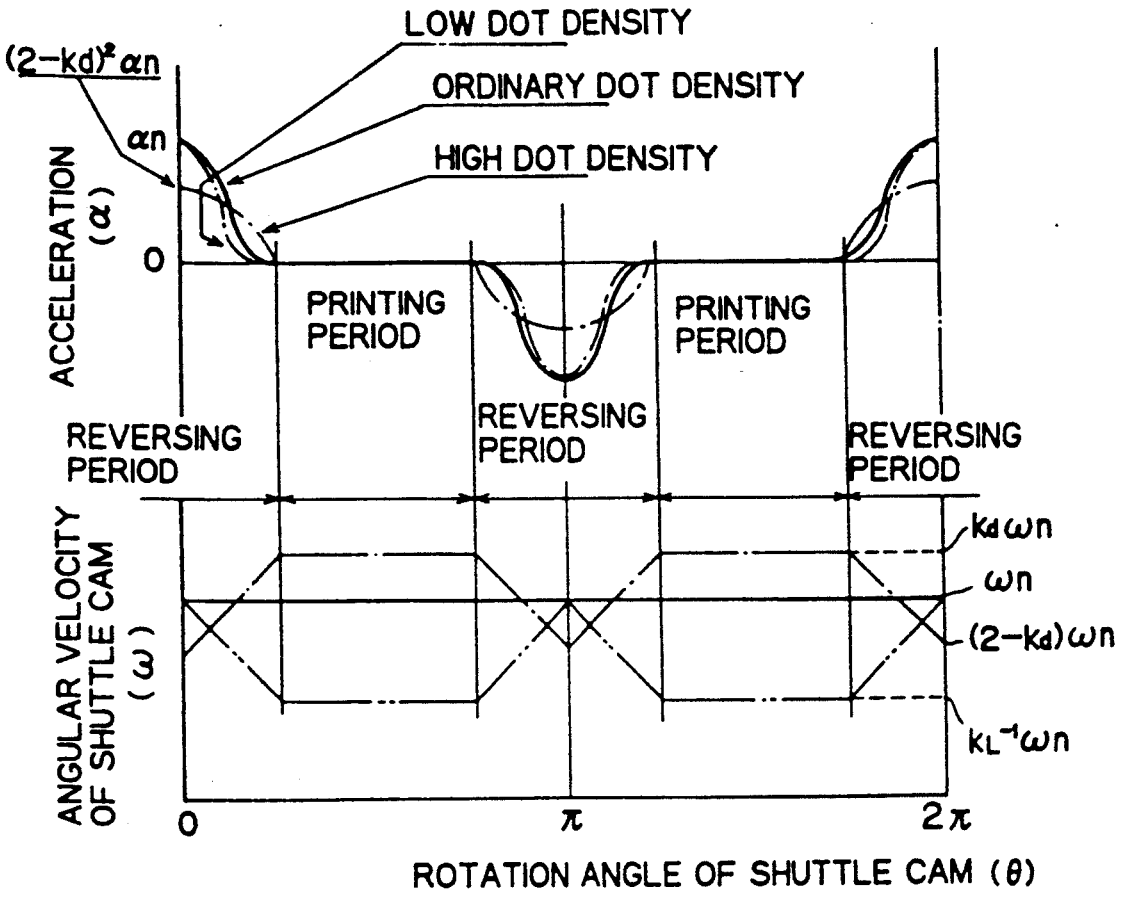
FIG. 15 is a graphical representation showing angular velocities of a shuttle cam (or a shuttle cam shaft) and acceleration thereof with respect to a rotational angular position of the shuttle cam in case of the ordinary dot density printing mode (solid line), the low dot density printing mode (a dotted chain line) and the high dot density printing mode (two dotted chain line) according to a third embodiment of the present invention.
Figure 16:
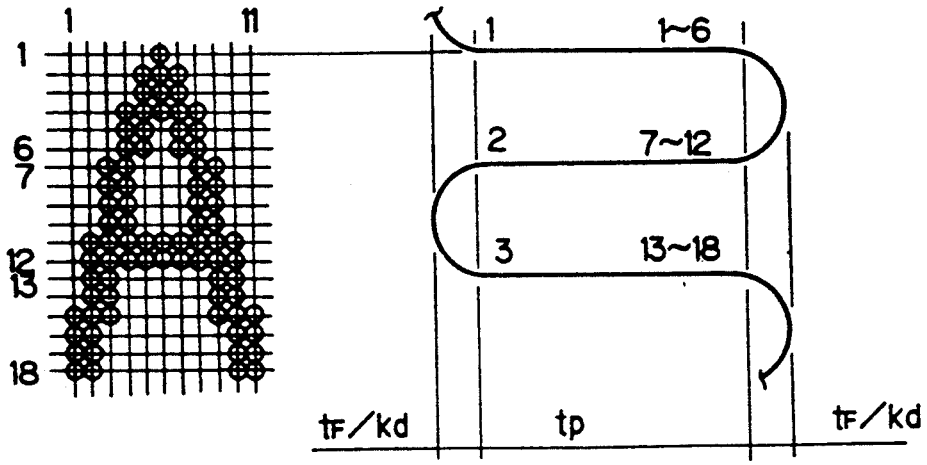
FIGS. 16 through 18 are views for description of ordinary dot density printing mode, low dot density printing mode and high dot density printing mode, respectively, in association with reversing and printing time periods according to the third embodiment of the present invention.

FIG. 15 shows angular velocity of a shaft of the shuttle cam 2 and acceleration thereof with respect to angular position of the shaft of the cam. In case of the ordinary dot density printing, as shown in FIG. 15, the shuttle motor 1 is rotated at a constant rotation speed. However, a lift characteristic of the shuttle cam 2 is altered so as to obtain reversing period of $t_F$kinstead of the conventional reversing period of $t_F$. This change can be easily done by modifying cam profile. As a result, obtained complete one directional moving time period $t_s'$ of the hammer bank 8 is represented by an equation $t_s'=t_P+(t_F/k_d)$. Consequently, printing speed $P_n$ (character lines per minute) is represented by the following equation.

$$P_n = \frac{20}{t_P + (t_F/k_d)}$$

Therefore, this print speed is faster than the conventional printing speed of $P_n=20\{t_P+t_F\}$.

Figure 17:
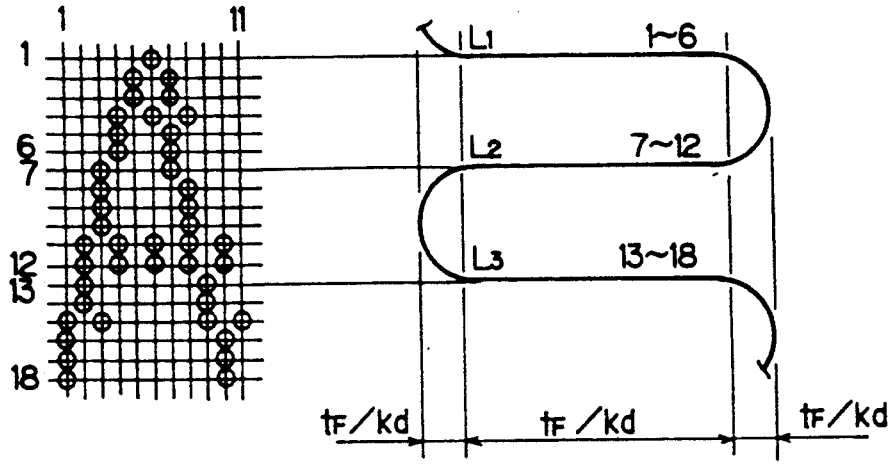

In case of the low dot density printing, conventionally, the shuttle motor 1 is rotated at a constant speed. However, according to the third embodiment, an average angular velocity of the shuttle motor 1 during the reversing period (see FIG. 15) is proximate to the angular velocity of the shuttle motor under the ordinary dot density printing. That is, when the angular position of the cam shaft is zero, the angular speed is set to $(2-k_d)\alpha_n$. On the other hand, rotation speed of the shuttle motor during the printing period is the same as the conventional speed. This speed control can be made by a control circuit 24 on a basis of an output signal indicative of the rotation speed of the shuttle motor 1 from an encoder 27. Accordingly, the printing under the low dot density is made as shown in FIG. 17. As a result, a complete one directional moving time period $t_d'$ of the hammer bank 8 is represented by $t_d'=(t_F+t_P)/k_{20}$, which is similar to the conventional value. Further, maximum acceleration falls to $(2-k_d)^2\alpha n^2$. This acceleration value is smaller than, that in the ordinary dot density printing.

Figure 18:
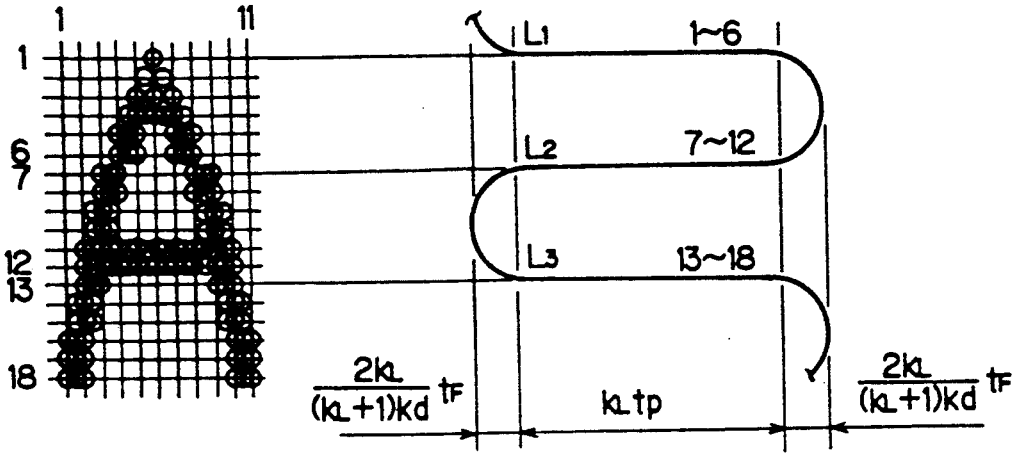

In the case of the high dot density printing, conventionally, the shuttle motor 1 is rotated at a constant speed. However, in the third embodiment, the angular velocity of the motor is changeable so that its average velocity is proximate to the velocity of the ordinary dot density printing. However, the velocity must be lower than a velocity which provides a maximum acceleration of $\alpha_n$. Thus, the angular velocity should be lower than $\alpha_n$ under the ordinary dot density printing mode. This control can be made in a manner similar to that in the low dot density printing. Accordingly, high dot density printing shown in FIG. 18 is provided.

In the high dot density printing mode, since the reversing period is represented by the formula of;

$$2k_L t_F/\{(k_L+1)k_d\}$$

and the printing period is $k_L t_P$, a complete one directional moving time period $t_L'$ of the hammer bank 8 is represented as follows:

$$t_L = \frac{2k_L}{(k_L+1)k_d} \cdot t_F + k_L \cdot t_P$$

Therefore, this period is shorter than the conventional time period of $t_L=(t_F+t_p)k_L$.

The following Table 1 shows time period, print speed and maximum acceleration in ordinary dot density printing (A), low dot density printing (B) and high dot density printing (C) according to the conventional system and the printer according to the third embodiment of the present invention. In the Table 1, group I and group II represent the conventional printer and the printer of the third embodiment, respectively. Further, Table 2 shows comparative data with respect to the time period, printing speed and maximum acceleration between the conventional printer and the printer according to the third embodiment, where $t_f=10.8$ ms, $t_p=32.7$ ms, $k_d=1.2$ and $k_L=2$.

As is apparent from the Table 1, in the third embodiment, the printing speed is improved in the ordinary dot density printing and high dot density printing, and maximum acceleration is decreased in the low dot density printing. Further, Table 2 reveals that printing speed in the ordinary dot density printing in the third embodiment was improved by 4.35 greater than that in the conventional printer. Further, the maximum acceleration in the low dot density in the third embodiment was lowered by 44.4% in comparison with that in the conventional printer. Furthermore, the printing speed in the high dot density printing in the third embodiment was improved by 12.4% greater than that in the conventional printer.

Therefore, in the dot line printer according to the third embodiment of this invention, reversing period in the ordinary dot density printing is changed to be equal to the conventional reversing period of low dot density printing mode by altering the profile of the shuttle cam. Further, average angular velocity of the shuttle motor in the reversing periods under the low dot density printing mode and the high dot density printing mode is set proximate to the angular velocity of the shuttle motor under the ordinary dot density printing mode. Therefore, ordinary and high dot density printings can be performed at high speed. Further, compact shuttle mechanism can be provided, since the maximum acceleration under the low dot density printing mode can be set to a level approximately similar to the maximum acceleration under the ordinary dot density printing mode.

While the invention has been described in detail and with reference to specific embodiments thereof, it would be apparent to those skilled in the art that various changes and modification may be made therein without departing from the spirit and scope of the invention. For example, the inventive concept of the third embodiment can be incorporated into the first embodiment.

TABLE 1

| | | Period | | | | |
|---|---|---|---|---|---|---|
| | | Reversing Period | Printing Period | Entire Period | Printing Speed | Maximum acceleration |
| (I) | (A) | $t_F$ | $t_P$ | $t_F + t_P$ | $\frac{20}{t_F + t_P}$ | $\alpha_n$ |

TABLE 1-continued

| | | Period: Reversing Period | Period: Printing Period | Period: Entire Period | Printing Speed | Maximum acceleration |
|---|---|---|---|---|---|---|
| | (B) | $\frac{t_F}{k_d}$ | $\frac{t_P}{k_d}$ | $\frac{t_F + t_P}{k_d}$ | $\frac{20}{t_F + t_P}$ | $k_d^2\,\alpha_n$ |
| | (C) | $k_L t_F$ | $k_L t_P$ | $k_L(t_F + t_P)$ | $\frac{20}{(t_F + t_P)k_L}$ | $\frac{\alpha_n}{k_L^2}$ |
| (II) | (A) | $\frac{t_F}{k_d}$ | $t_P$ | $\frac{t_F}{k_d} + t_P$ | $\frac{20}{t_F + k_d t_P}\,k_d$ | $\alpha_n$ |
| | (B) | $\frac{t_F}{k_d}$ | $\frac{t_P}{k_d}$ | $\frac{t_F + t_P}{k_d}$ | $\frac{20}{t_F + t_P}\,k_d$ | $(2 - k_d)^2\,\alpha_n$ |
| | (C) | $\frac{2k_L t_F}{(k_L + 1)k_d}$ | $k_L t_P$ | $\frac{2k_L t_F}{(k_L + 1)k_d} + k_L t_P$ | $20\left(\frac{2k_L t_F}{(k_L + 1)k_d} + k_L t_P\right)^{-1}$ | $\alpha_n$ |

TABLE 2

| | Period (ms): Reversing Period | Period (ms): Printing Period | Period (ms): Entire Period | Printing Speed (LPM) | Maximum Acceleration |
|---|---|---|---|---|---|
| (I) | | | | | |
| (A) | 10.8 | 32.7 | 43.5 | 459.8 | $\alpha_n$ |
| (B) | 9.0 | 27.25 | 36.25 | 551.7 | 1.44 $\alpha_n$ |
| (C) | 21.6 | 65.4 | 87.0 | 229.9 | 0.25 $\alpha_n$ |
| (II) | | | | | |
| (A) | 9.0 | 32.7 | 41.7 | 479.6 | $\alpha_n$ |
| (B) | 9.0 | 27.25 | 36.25 | 551.7 | 0.64 $\alpha_n$ |
| (c) | 12.0 | 65.4 | 77.4 | 258.4 | $\alpha_n$ |

What is claimed is:

1. A dot line printer for printing dot images on a printing sheet comprising:

a hammer bank comprising a plurality of print hammers arrayed in a shuttling direction, the hammer bank being reciprocally movable in the shuttling direction;

means for moving the printing sheet in a line to line direction;

a shuttling mechanism for moving the hammer bank in the shuttling direction, the shuttling mechanism comprising a shuttle motor and a cam mechanism drivingly connected to the hammer bank and having a shuttle cam driven by the shuttle motor, said shuttling mechanism moving the hammer bank through a printing region where the print hammers move toward the printing sheet for printing and a reversing region where the moving direction of the hammer bank is reversed and the print sheet is fed in the line to line direction, the hammer bank and the shuttling mechanism providing a first dot density printing mode having a first dot density and a second dot density printing mode having a second dot density less than the first dot density, wherein the shuttle motor rotates in the printing region at a first angular velocity in the first dot density printing mode and in the second dot density printing mode the hammer bank has a moving velocity greater than in the first dot density printing mode and the shuttle motor rotates in the printing region at a second angular velocity which is greater than the first angular velocity, wherein the shuttling cam has cam profile means for providing a predetermined reversing period for reversing the hammer bank when the shuttle motor is rotated at a predetermined third angular velocity which is in the range between the first and second angular velocities, and wherein the shuttle motor accelerates and decelerates the hammer bank for providing the predetermined reversing period during a reversing operation in both the first and second dot density printing modes.

2. The dot line printer as claimed in claim 1, wherein the cam profile provides the predetermined reversing period when the shuttle motor rotates at an angular velocity which is closer to the first angular velocity than to the second angular velocity.

3. The dot line printer as claimed in claim 1, wherein the cam profile means provides the predetermined reversing period when the shuttle motor rotates at an angular velocity which is closer to the second angular velocity than to the first angular velocity.

4. The dot line printer as claimed in claim 1, wherein the cam profile means provides the predetermined reversing period when the shuttle motor rotates at an angular velocity substantially intermediate between the first angular velocity and the second angular velocity.

5. The dot line printer as claimed in claim 1, wherein the hammer bank and the shuttle mechanism provides the ordinary dot density printing mode, the low dot density printing mode and a high dot density printing mode, and further comprising control means connected to the shuttle motor for controlling a rotation speed of the shuttle motor at the reversing region under the low dot density and high dot density printing modes so as to provide an average rotation speed substantially the same as a rotation speed in the reversing region under the ordinary dot density printing mode.

6. The dot line printer as claimed in claim 1, further comprising control means connected to the shuttle motor for controlling an average rotation speed of the shuttle motor at the reversing region to a level substantially intermediate between a rotation speed of the shuttle motor at the ordinary dot density printing mode and a rotation speed of the shuttle motor at the low dot density printing mode.

* * * * *